United States Patent [19]

Touton, III

[11] Patent Number: 4,956,940

[45] Date of Patent: Sep. 18, 1990

[54] BOTTOM OFFSET DOOR PIVOT AND SPLINE THRESHOLD

[75] Inventor: Charles P. Touton, III, Buford, Ga.

[73] Assignee: Kawneer Company, Inc., Norcross, Ga.

[21] Appl. No.: 500,688

[22] Filed: May 28, 1990

[51] Int. Cl.[5] ..... E05D 7/08

[52] U.S. Cl. ..... 49/388; 49/467; 16/379

[58] Field of Search ..... 49/388, 467, 468, 469, 49/470, 471, 389; 160/206; 16/378, 379, 381

[56] References Cited

U.S. PATENT DOCUMENTS

| | | | |
|---|---|---|---|
| 2,923,036 | 2/1960 | Beyrle | 49/388 |
| 3,145,414 | 8/1964 | Martin | 16/378 |
| 3,320,699 | 5/1967 | Carson et al. | 49/388 |
| 3,478,383 | 11/1969 | Brooks | 16/379 X |

*Primary Examiner*—Philip C. Kannan

*Attorney, Agent, or Firm*—Jones, Askew & Lunsford

[57] ABSTRACT

An improved bottom offset door pivot is disclosed which comprises an elongated threshold and a door pivot body. The threshold has a keyway formed therein in a direction generally parallel to the axis of elongation of the threshold. The door pivot body has a pivot spindle projecting upwardly therefrom for pivotably mounting a lower portion of a door to the pivot body. The pivot body further has a hook formed thereon configured to mechanically hook into the keyway in the threshold. A flange formed on the lower surface of the pivot body engages a groove formed in the upper surface of the threshold. The flange is disposed relative to the pivot spindle such that when the flange engages the keyway, the pivot spindle is properly offset with respect to the threshold. In the disclosed embodiment, when the lateral edge of the pivot body abuts the vertical door jamb, the pivot spindle is properly offset with respect to the doorjamb. The bottom offset door pivot of the present invention eliminates the necessity for notching the frame and threshold and thereby provides a simple method for securing the offset door pivot to the threshold. The door pivot further provides the advantage that a single pivot may be used for either left- or right-handed doors.

6 Claims, 3 Drawing Sheets

BOTTOM OFFSET DOOR PIVOT AND SPLINE THRESHOLD

TECHNICAL FIELD

The present invention relates generally to apparatus for mounting doors and relates more specifically to an improved bottom offset door pivot and threshold which provides a simplified method of attaching the pivot to a pocketed doorjamb.

BACKGROUND OF THE INVENTION

Pivots for movably mounting a door to a door frame are well known. Door pivots typically comprise a bottom pivot anchored to the threshold or to the door jamb, which pivotably cooperates with a second portion mounted to the face of the door. A door pivot differs from a hinge primarily in that the axis of rotation of a hinge is coincident to or outside the lateral edge of the door, whereas the axis of rotation of a pivot falls inside the lateral edges of the door.

Door pivots are broadly categorized according to their intended mounting position on the door. All doors require at least two pivots, a top pivot and a bottom pivot. Top pivots do not bear a major portion of the weight of the door but instead are designed primarily to provide an upper pivot point for the door and to withstand lateral forces exerted against the door resulting from the torque applied to open the door. The bottom pivot is the primary load bearing pivot and typically includes a ball bearing located in the door portion of the pivot for enhanced load carrying capability.

Door pivots may be further categorized as either center pivots or offset pivots, depending upon where the axis of rotation of the pivot lies in a vertical plane with respect to the door. With a center pivot, the axis of rotation falls in a vertical plane intermediate the inner and outer stiles of the door. Center pivots are primarily used when it is desired to mount a door which can pivot in both directions. However, in order to position the axis of rotation intermediate the stiles of the door, channels or recesses must be cut into the stiles to mount the pivot. While center pivots are acceptable for mounting interior or vestibule doors, the interruptions in the door required to mount a center pivot make the center pivot undesirable for exterior applications which require weather sealing, since the channels which are cut into the lateral edge of the door to mount the door pivot will permit air and water to pass through.

For such exterior applications which require weather sealing, the offset door pivot is the more desirable alternative. A typical bottom offset door pivot installation is depicted in FIG. 1 of the drawings and includes a generally L-shaped body having a horizontal base portion and an upwardly extending bracket portion. The upwardly extending bracket portion is received within the hollow vertical jamb on the pivot side of the door. The base portion has a recess formed thereon into which a portion of the threshold is received. An upwardly extending spindle is formed on the base portion and is offset from the bracket portion. The spindle cooperates with a corresponding bore on the door portion of the pivot assembly to pivotably mount the door.

One of the difficulties presented by a conventional offset door pivot installation is the requirement that the vertical pivot jamb and the threshold be mortised or otherwise notched to accommodate the bottom pivot. In addition, various punching, drilling, and tapping operations are necessary to mount the door pivot to the door jamb and threshold. These notching, punching, drilling, and tapping operations require time, special machinery, and skilled labor, which increases the cost of installing the door pivot. Thus, there is a need to provide a bottom offset door pivot which minimizes the amount of machining of the door jamb and threshold which is required to install the pivot.

Another problem associated with conventional bottom offset pivots is that a given pivot assembly will be either left-handed or right-handed, depending upon the direction in which the spindle is offset with respect to the bracket member. Such handed pivots cannot be used interchangeably and thus double the inventory of pivots which a building supplier must keep on hand. Further, the possibility of error is introduced, in that a worker may arrive at the work site with, for example, a left-handed pivot to hang a right-handed door, thereby causing aggravation, delay, and increased cost of installation. Finally, there is the possibility that a worker may attempt, either accidentally or unknowingly, to install a wrong-handed pivot for a particular application. Thus, there is a need to provide a non-handed bottom offset door pivot.

SUMMARY OF THE INVENTION

As will be seen, the present invention overcomes these and other problems associated with prior art door pivot installations. The present invention eliminates the necessity for notching the frame and threshold and thereby provides a simple method for securing the offset door pivot to the threshold. The present invention further provides the advantage that a single pivot may be used for either left- or right-handed doors.

Stated somewhat more specifically, the present invention comprises an elongated threshold and an offset door pivot body. The threshold has a keyway or spline formed therein in a direction generally parallel to the axis of elongation of the threshold. The offset door pivot body has a pivot spindle projecting upwardly therefrom for pivotably mounting a lower portion of a door to the pivot body. The pivot body further has a hook formed thereon configured to mechanically hook into the keyway in the threshold. The flange is disposed relative to the pivot spindle such that when the flange engages the keyway, the pivot spindle is properly offset with respect to the threshold. In the disclosed embodiment, a flange formed on the lower surface of the pivot body engages a groove formed in the upper surface of the threshold to further anchor the pivot body to the threshold. Also in the disclosed embodiment, when the lateral edge of the door pivot body abuts the vertical door jamb, the pivot spindle is properly offset with respect to the doorjamb. In one aspect of the invention, the door pivot body is symmetrical about a center plane such that the door pivot may be used on either the right- or left-hand side of the door.

Thus, it is an object of the present invention to provide an improved offset door pivot arrangement.

It is another object of the present invention to provide an offset door pivot arrangement which affords improved ease of installation.

It is a further object of the present invention to provide a bottom offset door pivot which minimizes the amount of machining of the door jamb and threshold which is required to install the pivot.

Yet another object of the present invention is to provide an offset door pivot wherein a single pivot may be used for either left- or right-handed doors.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
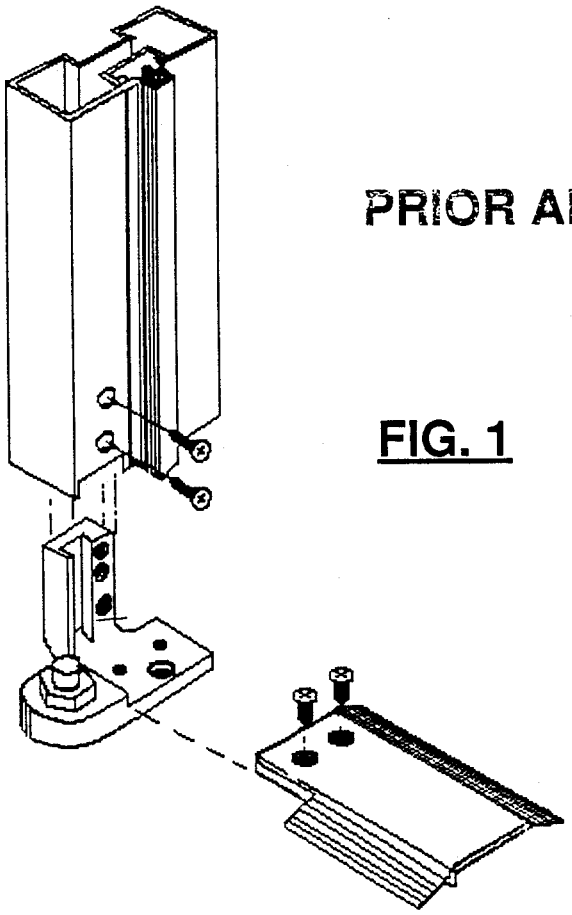
PRIOR ART FIG. 1
FIG. 1 depicts a prior art bottom offset door pivot.
Figure 2:
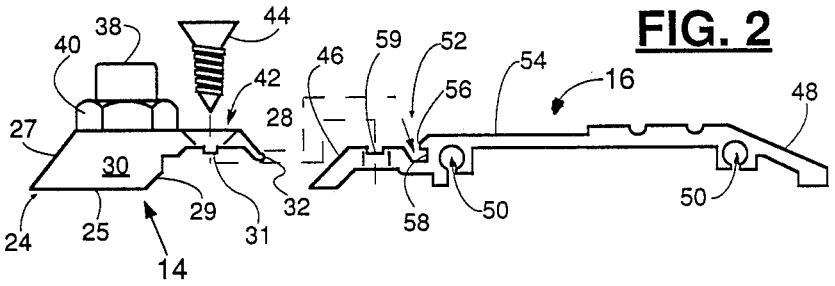
FIG. 2 is a side view of a bottom offset door pivot and spline threshold according to the present invention.
Figure 3:
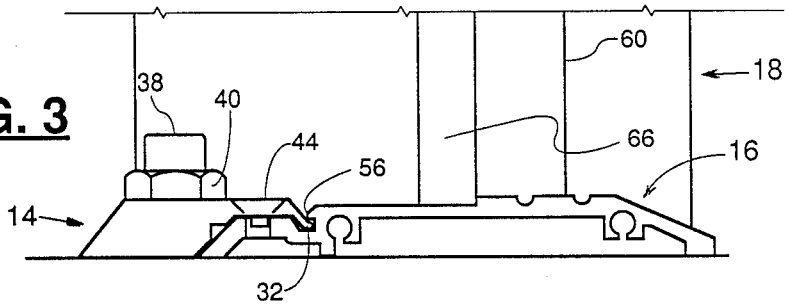
FIG. 3 is a side view of the bottom offset door pivot and spline threshold of FIG. 2 assembled with a vertical door jamb.
Figure 4:
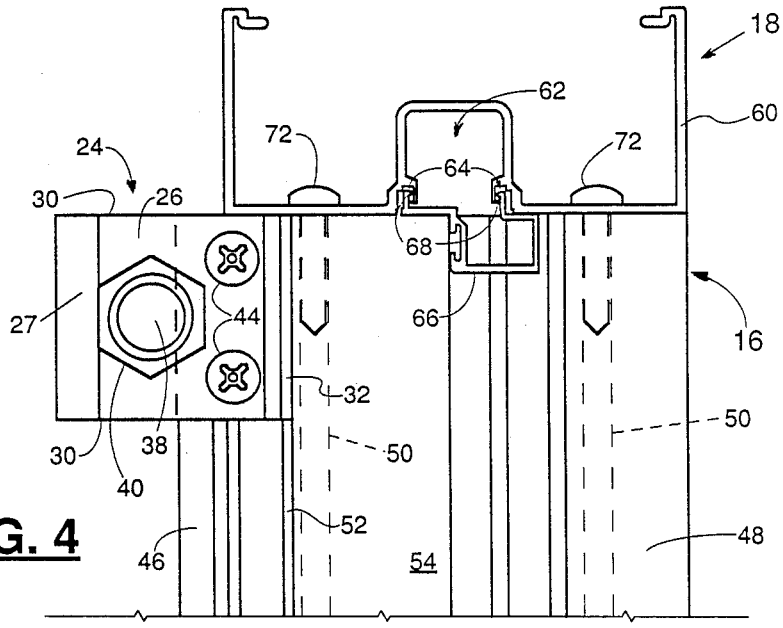
FIG. 4 is a top view of the assembled bottom offset door pivot, spline threshold, and vertical door jamb of FIG. 3.
Figure 5:
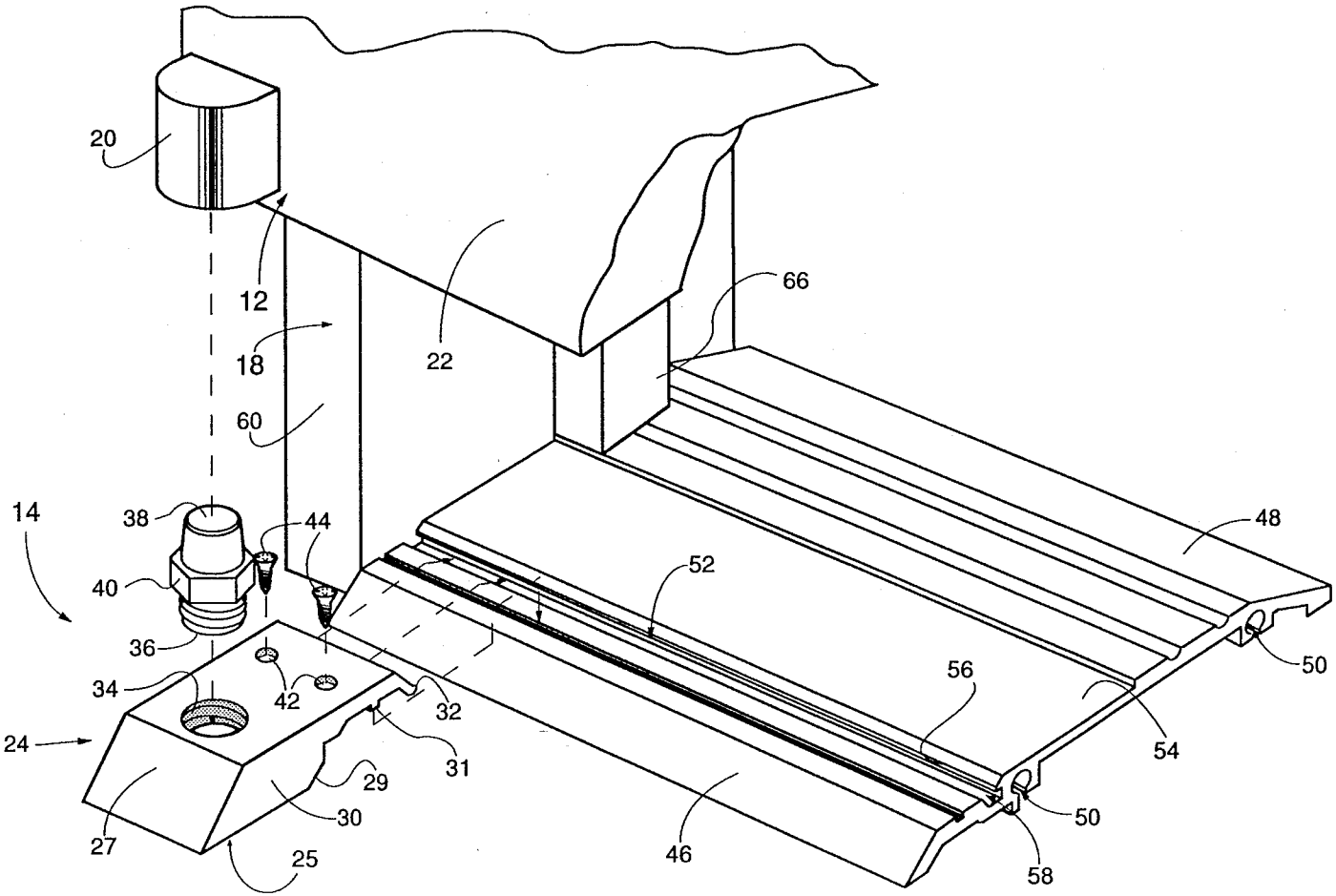
FIG. 5 is an exploded perspective view of the assembled bottom offset door pivot, spline threshold, and vertical door jamb of FIG. 3 with a door partially cut away to reveal detail.

Referring now in more detail to the drawings, in which like numerals indicate like elements throughout the several views, and in which FIG. 1 depicts a prior art bottom offset door pivot previously described in the background of the invention, FIGS. 2–5 illustrate an apparatus 10 according to the present invention for pivotably mounting the lower end of a door 12. The apparatus 10 comprises a bottom offset door pivot 14 and a threshold 16 mounted in conjunction with a vertical door jamb 18. The door 12 includes a bottom door pivot portion 20 mounted to its lower face 22. The door pivot portion 20 includes a ball bearing located within its bore (not shown) for enhanced load carrying capability. The door 12 and door pivot portion 20 are of conventional design well known to those of ordinary skill in the art.

The bottom offset door pivot 14 comprises a pivot body 24 formed from aluminum or the like. The pivot body 24 has a base 25, an upper surface 26, a bevelled first end 27, a second end 28, a bevelled lower bearing surface 29, and mutually opposing lateral edges 30. The pivot body 24 has a flange 31 located underneath the second end 28. The pivot body 24 further has a hook 32 located at the second end 28. The pivot body 24 has a threaded bore 34 formed in its upper surface 26 into which the correspondingly threaded lower end 36 of a pivot spindle 38 is received. The pivot spindle 38 includes a hexagonal body portion 40 by which the spindle may be turned in a conventional manner to thread the spindle into the pivot body 24. The pivot body 24 further comprises a pair of countersink bores 42 formed through the upper surface 26 through which a pair of screws 44 are received to anchor the pivot body to the threshold 16 in the manner to be explained below.

The threshold 16 is formed as an aluminum extrusion of indeterminate length and is cut to a length approximately equal to the distance between the vertical door jambs. The threshold 16 has a generally convex cross-sectional profile including bevelled front and back faces 46, 48. The extrusion includes a pair of screw slots 50 formed underneath the threshold 16. A keyway or spline 52 is formed in the upper surface 54 of the threshold and includes a lip 56 projecting over a channel 58. A groove 59 is also defined in the upper surface 54 of the threshold.

The vertical doorjamb 18 comprises an extruded aluminum frame member 60 of conventional design and includes a glazing pocket 62 with gasket raceways 64 formed therewithin. A door stop 66 snaps over the glazing pocket 62 by means of flanges 68 which engage the gasket raceways 64. It will be understood that the exact configuration of the vertical doorjamb is not critical to the invention and that the doorjamb 18 is shown for purposes of illustration only.

The interaction of the various components will become apparent from the assembly of the door installation now to be described. The door frame including the vertical doorjamb 18 and stop member 66 is first erected. The threshold 16 is then positioned on the floor between the vertical jambs and is fastened to the jambs by a pair of screws 72 inserted through the frame member 60 and into the screw slots 50 beneath the threshold 16. With the doorjambs and threshold thus assembled, the door pivot 14 is ready for installation.

The second end 28 of the pivot body 24 is tilted downward so that the hook 32 can be inserted into the keyway 52 in the upper surface 54 of the threshold 16. The first end 27 of the pivot body 24 is then lowered so that the tip of the hook 32 is captured beneath the lip 56. As the pivot body is lowered to a horizontal position, the flange 31 underneath the second end of the pivot body engages the groove 59 in the upper surface of the threshold to further anchor the pivot body to the threshold. The bevelled lower bearing surface 29 of the pivot body 24 abuts the bevelled front face 46 of the threshold 16. The pivot body 24 is slid toward the end of the threshold 16 until the corresponding lateral edge 30 of the pivot body abuts the face of the vertical doorjamb 18. With the door pivot 14 thus positioned, the screws 44 are inserted through the countersink bores 42 in the pivot body 24 and threaded into the underlying portion of the threshold 16 to anchor the door pivot with respect to the threshold. Installation of the door pivot 14 is completed by threading the pivot spindle into the bore 34 in the upper surface 26 of the pivot body 24 by means of the hexagonal body portion.

With the door pivot 14 thus installed, the door 12 is assembled onto the pivot in the conventional manner, the upper end of the pivot spindle 38 being received within the corresponding bore in the door pivot portion 20. The upper end of the door is pivotably mounted by means of an upper offset door pivot of conventional design in a manner well known to those skilled in the art to complete the installation of the door.

The door mounting arrangement of the present invention includes a number of features. First, the door pivot is installed without having to cut, notch, or otherwise machine the threshold or doorjamb, thus enhancing ease of installation. Second, the configuration of the door pivot and threshold permits the pivot to be installed at either the left or right end of the threshold. Thus, the symmetry of the door pivot and spline threshold permits its use in either left- or right-handed installations.

It will be understood that the bottom offset door pivot and spline threshold of the present invention are used with a conventional door bottom pivot portion. In addition, the entire upper offset door pivot assembly is of conventional design. Since conventional door bottom pivot portions and upper offset door pivot assemblies are well within the knowledge of those skilled in the art, detailed disclosure is not considered necessary.

Further, while the invention has been disclosed with respect to an embodiment comprising a vertical doorjamb having a particular configuration, it will be understood that the configuration of the doorjamb is of no consequence to the invention and that other designs of door frames may be substituted as the particular application may dictate.

Finally, it will be understood that the preferred embodiment has been disclosed by way of example, and that other modifications may occur to those skilled in the art without departing from the scope and spirit of the appended claims.

What is claimed is:

1. An apparatus for pivotably supporting a lower portion of a door, comprising:

a threshold having an axis of elongation, said threshold having a keyway formed therein in a direction generally parallel to said axis of elongation;

an offset door pivot body configured to abut said threshold, said pivot body having a pivot spindle projecting upwardly therefrom for pivotably mounting a lower portion of a door to said body; and a hook formed on said pivot body and configured to mechanically hook into said keyway in said threshold, said hook being disposed relative to said pivot spindle such that when said hook engages said keyway said pivot spindle is properly offset with respect to said threshold.

2. The apparatus of claim 1, wherein said keyway comprises a generally horizontal lip configured such that when said hook mechanically hooks into said keyway said flange is captured beneath said lip.

3. The apparatus of claim 1, wherein said offset door pivot body has a lateral edge, and wherein said pivot spindle is disposed with respect to said lateral edge such that when said threshold intersects a vertical doorjamb and said lateral edge of said pivot body abuts said vertical doorjamb, said door pivot is properly offset with respect to said doorjamb.

4. The apparatus of claim 1, wherein said offset door pivot body is symmetrical about a central plane such that said pivot body may be installed against either a left- or right-hand vertical doorjamb.

5. The apparatus of claim 1, further comprising fastening means for anchoring said pivot body to said threshold after said flange has been hooked into said keyway.

6. The apparatus of claim 1, wherein said threshold further comprises a groove formed in the upper surface thereof, and wherein said pivot body further comprises a flange formed on a lower portion thereof and disposed to engage said groove to further anchor said pivot body to said threshold.

* * * * *